US006487387B2

(12) United States Patent
Kusaba et al.

(10) Patent No.: US 6,487,387 B2
(45) Date of Patent: Nov. 26, 2002

(54) FULL-COLOR IMAGE FORMING APPARATUS WITH BELT-SHAPED TRANSFER MEMBER

(75) Inventors: Takashi Kusaba, Shizuoka (JP); Akihiko Nakazawa, Shizuoka (JP); Akira Shimada, Shizuoka (JP); Atsushi Tanaka, Shizuoka (JP); Tsunenori Ashibe, Kanagawa (JP); Hidekazu Matsuda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/981,708

(22) Filed: Oct. 19, 2001

(65) Prior Publication Data

US 2002/0090234 A1 Jul. 11, 2002

(30) Foreign Application Priority Data

Oct. 24, 2000 (JP) ..... 2000-323931

(51) Int. Cl.[7] ..... G03G 15/01; G03C 15/16

(52) U.S. Cl. ..... 399/302; 399/303; 399/101; 430/126

(58) Field of Search ..... 399/101, 302, 399/303; 430/47, 126, 110.3

(56) References Cited

U.S. PATENT DOCUMENTS

| | | | | |
|---|---|---|---|---|
| 5,116,711 A | | 5/1992 | Kobayashi et al. | 430/106 |
| 5,149,610 A | | 9/1992 | Kobayashi et al. | 430/106 |
| 5,164,275 A | | 11/1992 | Kobayashi et al. | 430/45 |
| 5,256,512 A | | 10/1993 | Kobayashi et al. | 430/106 |
| 5,995,794 A | | 11/1999 | Osada et al. | 399/302 |
| 6,341,205 B1 | * | 1/2002 | Yoshino et al. | 399/101 |

FOREIGN PATENT DOCUMENTS

| | | | |
|---|---|---|---|
| JP | 36-10231 | | 3/1934 |
| JP | 56-13945 B2 | | 4/1981 |
| JP | 59-53856 | | 3/1984 |
| JP | 59-61842 | | 4/1984 |
| JP | 63-301960 | | 12/1988 |
| JP | 8-63071 A | * | 3/1996 |
| JP | 8-320591 | | 12/1996 |
| JP | 9-258474 | | 10/1997 |

* cited by examiner

*Primary Examiner*—Joan Pendegrass
(74) *Attorney, Agent, or Firm*—Fitzpatrick, Cella, Harper & Scinto

(57) ABSTRACT

A full-color image forming apparatus for forming an image on a transfer material by transferring a toner image formed on an image bearing member onto the transfer material includes a belt-shaped transfer member for transferring a toner image from the image bearing member onto a transfer material, and a cleaning blade for cleaning the belt-shaped transfer member by being brought into contact therewith. Shape coefficients SF-1 and SF-2 of a toner for forming the toner image have values of $100 \leqq SF\text{-}1 \leqq 125$, and $100 \leqq SF\text{-}2 \leqq 125$, respectively. The belt-shaped transfer member has a seamless shape in which a seam is absent. An amount of abrasion of a surface of the belt-shaped transfer member is equal to or less than 10.0 mg. An angle of contact with respect to water of the belt-shaped transfer member is at least 60°. A slide resistance of a surface of the belt-shaped transfer member is equal to or less than 1 N.

13 Claims, 2 Drawing Sheets

FULL-COLOR IMAGE FORMING APPARATUS WITH BELT-SHAPED TRANSFER MEMBER

BACKGROUND OF THE INVENTION

1. Field of the Invention

The present invention relates to an image forming apparatus including belt-shaped transfer members, such as an intermediate transfer belt, a transfer belt, and the like.

2. Description of the Related Art

An image forming apparatus which uses belt-shaped transfer members, such as an intermediate transfer belt (for obtaining an image by transferring a toner image formed on a photosensitive member onto the intermediate transfer belt before transferring the toner image onto a transfer material, such as paper or the like, and thereafter transferring the toner image on the intermediate transfer belt onto the transfer material), a transfer-material conveying belt (for conveying the transfer material to a transfer region in order to transfer the toner image formed on the photosensitive member onto the transfer material), and the like, is effective as a color image forming apparatus or a multicolor image forming apparatus for outputting a color image or a formed image reproduced by synthesizing multicolor images, by sequentially transferring and laminating a plurality of component color images included in color image information or multicolor image information, or an image forming apparatus having a color image forming function or a multicolor image forming function. In such an image forming apparatus, a high-grade cleaning property is required for both of the intermediate transfer belt and the transfer-material conveying belt. Hence, the related art will be described illustrating the intermediate transfer belt.

FIG. 1 is a schematic diagram illustrating a color image forming apparatus (a copying machine or a laser-beam printer) which utilizes an electrophotographic process. In FIG. 1, a drum-shaped electrophotographic photosensitive member (hereinafter termed a "photosensitive drum") 1, serving as an image bearing member, is rotatably driven in the direction of an arrow at a predetermined circumferential speed (process speed). In a charging process, the photosensitive drum 1 is uniformly charged to a predetermined potential of a predetermined polarity by a primary charger 2, and is then subjected to exposure 3 by, image exposure means (not shown). Thus, an electrostatic latent image corresponding to a first color component image (for example, a yellow color component image) of a target color image is formed.

Then, the electrostatic latent image is developed to provide a yellow component image, serving as a first color image, by a first developing unit (a yellow color developing unit 4Y in this case). At that time, since second through fourth developing units, i.e., a magenta color developing unit 4M, a cyan color developing unit 4C and a black color developing unit 4K, do not operate on the photosensitive drum 1, the yellow component image, serving as the first color image, is not influenced by the above-described second through fourth developing units.

An intermediate transfer belt 6 is rotatably driven in the direction of an arrow at a surface moving speed which is substantially the same as (or slightly higher than) the circumferential speed of the photosensitive drum 1. The yellow component image, serving as the first color image, formed on the photosensitive drum 1 is sequentially transferred (subjected to primary transfer) onto the outer circumferential surface of the intermediate transfer belt 6 by an electric field formed by a primary transfer bias voltage applied from a bias-voltage power supply 12 to the intermediate transfer belt 6 via a primary transfer roller 8, while passing through a nip portion between the photosensitive drum 1 and the intermediate transfer belt 6. The primary transfer bias voltage is, for example, within a range between +100 V and +2 kV.

The surface of the photosensitive drum 1 after transfer of the yellow toner image, serving as the first color image, while contacting the intermediate transfer belt 6 is cleaned by a cleaning device 5. Similarly, a magenta toner image, serving as a second color image, a cyan toner image, serving as a third color image, and a black toner image, serving as a fourth color image, are sequentially transferred onto the intermediate transfer belt 6 in a superposed state, to form a synthesized color toner image corresponding to the target color image on the intermediate transfer belt 6.

In the above-described primary transfer process of the toner images of the first through third colors from the photosensitive drum 1 onto the intermediate transfer belt 6, a secondary transfer roller 9 and a belt cleaner 7 are separated from the intermediate transfer belt 6. The secondary transfer roller 9 is disposed at a portion below the intermediate transfer belt 6 by being supported so as to be parallel to a secondary-transfer facing roller 16. After forming the synthesized color toner image corresponding to the target color image on the intermediate transfer belt 6, the secondary transfer roller 9 contacts the intermediate transfer belt 6, a transfer material 10 is fed from a feeding roller 18 to a contact portion between the intermediate transfer belt 6 and the secondary transfer roller 9 at a predetermined timing, and a secondary transfer bias voltage is applied from a bias-voltage power supply 17 to the secondary transfer roller 9. The synthesized color toner image transferred onto the intermediate transfer belt 6 is thereby subjected to secondary transfer onto the transfer material 10.

The transfer material 10 onto which the synthesized color toner image has been transferred is guided to a fixing unit 13 to be fixed by being heated. Upon completion of image transfer onto the transfer material 10, the belt cleaner 7 is brought into contact with the intermediate transfer belt 6 in order to clean toner particles remaining on the intermediate transfer belt 6 after image transfer.

In contrast to a conventional color electrophotographic apparatus including an image forming apparatus in which a transfer material is attached or attracted on a transfer drum and an image is transferred from an image bearing member onto the transfer material, for example, a transfer device described in Japanese Patent Application Laid-Open (Kokai) No. 63-301960 (1988), the above-described color electrophotographic apparatus having the image forming apparatus using the intermediate transfer belt has the advantage that, since an image can be transferred from the intermediate transfer belt without requiring any processing or control (for example, grasping on a gripper, attracting, or providing a curvature) for the transfer material, image transfer can be realized irrespective of the width or the length of the transfer material, ranging from thin paper of about 40 g/m$^2$ to thick paper of about 200 g/m$^2$, such as an envelope, a postcard, label paper or the like.

Although in the case shown in FIG. 1, a first-color toner image through a fourth-color toner image are sequentially transferred from one photosensitive member onto an intermediate transfer belt, there are a method for forming toner images of respective color components on a plurality of corresponding photosensitive members and sequentially transferring the toner images onto an intermediate transfer belt, a method for forming toner images of a plurality of color components on one photosensitive member and then simultaneously transferring the toner images onto an intermediate transfer belt, and the like. There are, of course, electrophotographic apparatuses each using an intermediate transfer belt in which a full-color image is output after passing through an image forming process other than the above-described process. Image forming apparatuses, such as color copiers, color printers and the like, each using such a belt-shaped transfer member have started to operate on the market.

However, when repeatedly using an image forming apparatus using a belt-shaped transfer member actually in various environments, the following problems still exist.

For example, the efficiency of transferring toner from an image bearing member, such as a photosensitive drum, onto a transfer member, such as an intermediate transfer member or the like, or onto a transfer material, and the efficiency of transferring toner from a transfer member, such as an intermediate transfer member or the like, onto a transfer material are not yet sufficiently high. Accordingly, it is required to provide a cleaning device for the transfer member. Particularly when a large amount of toner particles remain after image transfer, the lives of members, such as the transfer member and the like, are shortened, and the cleaning device inevitably has a complicated configuration and a high cost, resulting in a high cost of the apparatus.

In order to improve the efficiency of toner transfer, the inventors of the present invention have proposed, as described in Japanese Patent Application Laid-Open (Kokai) No. 8-320591 (1996), to achieve improvement of the transfer efficiency by specifying the shape of toner and the surface characteristics of an intermediate transfer member.

As for a cleaning member for a transfer member, various cleaning methods have been proposed, such as a cleaning method using a brush-shaped cleaning member, a cleaning method using an electric field, and the like. Among these cleaning methods, a blade cleaning method is preferable because the structure of a cleaning device is relatively simple, and reliability is high, and a low cost can be realized.

In the above-described approach described in Japanese Patent Application Laid-Open (Kokai) No. 8-320591 (1996), when using a cleaning blade as a member for cleaning toner particles remaining on an intermediate transfer member after image transfer, a failure in cleaning sometimes occurs. Such a phenomenon is pronounced when using a belt-shaped member as the intermediate transfer member. It is considered that in contrast to a case of using a stiff intermediate transfer member having the shape of a roller or the like, in the case of using a belt-shaped transfer member, uniform contact of a blade is difficult to realize.

In Japanese Patent Application Laid-Open (Kokai) No. 9-258474 (1997), image formation is performed by combining spherical toner with an apparatus including an intermediate transfer belt. However, no consideration has been taken to the physical properties of the intermediate transfer belt.

SUMMARY OF THE INVENTION

It is an object of the present invention to provide a full-color image forming apparatus including a belt-shaped transfer member and having a high transfer efficiency and a stable cleaning property.

According to one aspect, the present invention which achieves the above-described object relates to a full-color image forming apparatus for forming an image on a transfer material by transferring a toner image formed on an image bearing member onto a transfer material. The apparatus includes a belt-shaped transfer member for transferring a toner image from the image bearing member onto a transfer material, and a cleaning blade for cleaning the belt-shaped transfer member by being brought into contact therewith. Shape coefficients SF-1 and SF-2 of a toner for forming the toner image have values of $100 \leqq SF\text{-}1 \leqq 125$, and $100 \leqq SF\text{-}2 \leqq 125$, respectively. The belt-shaped transfer member has a seamless shape in which a seam is absent. An amount of abrasion of a surface of the belt-shaped transfer member is equal to or less than 10.0 mg. An angle of contact of the belt-shaped transfer member with respect to water is at least 60°. A slide resistance of a surface of the belt-shaped transfer member is equal to or less than 1 N.

The foregoing and other objects, advantages and features of the present invention will become more apparent from the following detailed description of the invention taken in conjunction with the accompanying drawings.

DETAILED DESCRIPTION OF THE INVENTION

Figure 1:
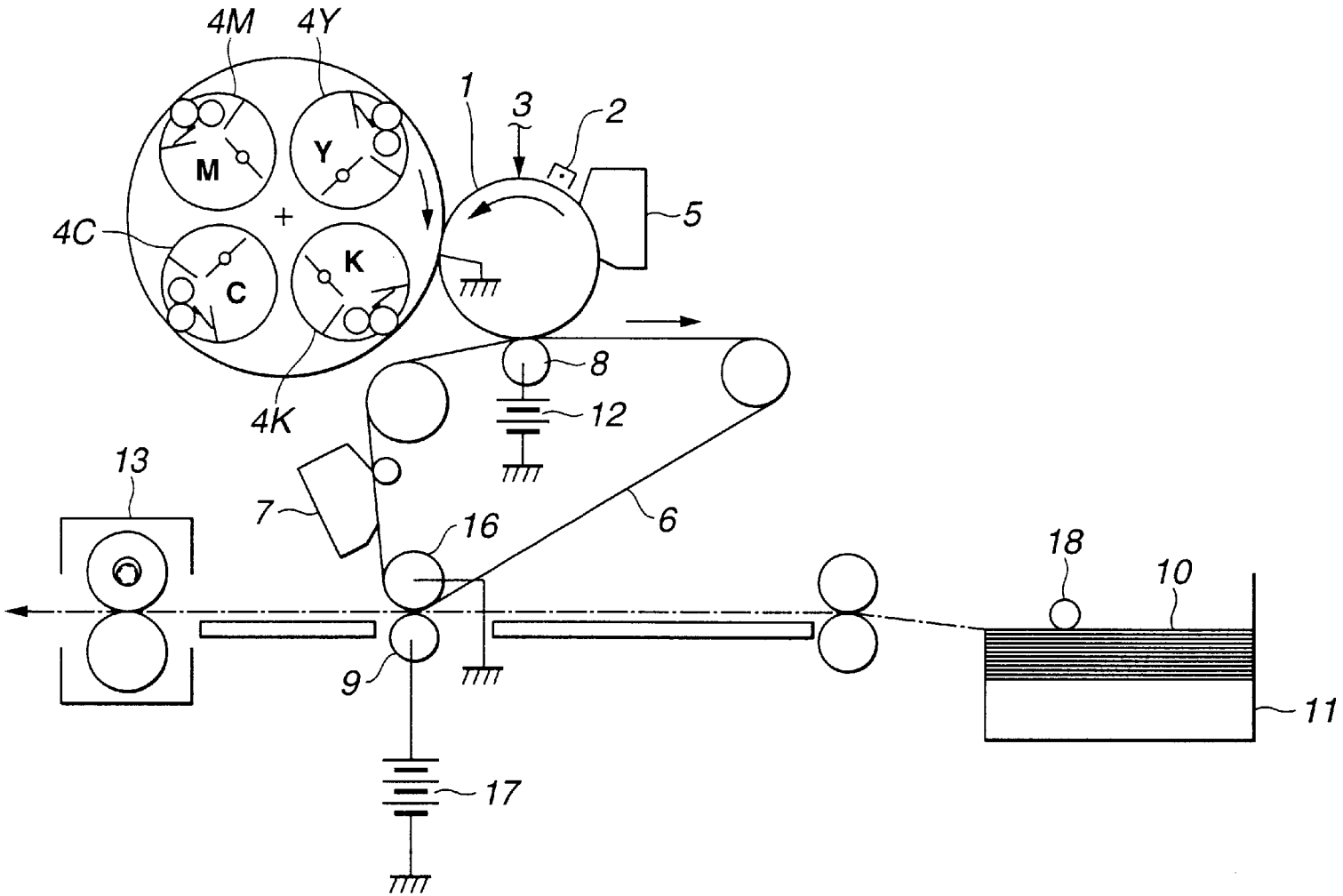
FIG. 1 is a schematic diagram illustrating an example of the configuration of an image forming apparatus utilizing an electrophotographic process applied to the present invention.

As a result of intensive investigations for achieving the above-described object, the inventors of the present invention have found that the above-described object can be achieved by limiting each set of shape coefficients of toner used for image formation and the surface characteristics of a belt-shaped transfer member within a preferable range, and have completed an image forming apparatus according to the present invention.

That is, the above-described object is achieved by a full-color image forming apparatus for forming an image on a transfer material by transferring a toner image formed on an image bearing member onto the transfer material. The apparatus includes a belt-shaped transfer member for transferring a toner image from the image bearing member onto a transfer material, and a cleaning blade for cleaning the belt-shaped transfer member by being brought into contact therewith. Shape coefficients SF-1 and SF-2 of a toner for forming the toner image have values of $100 \leqq SF\text{-}1 \leqq 125$, and $100 \leqq SF\text{-}2 \leqq 125$, respectively. The belt-shaped transfer member has a seamless shape in which a seam is absent. An amount of abrasion of a surface of the belt-shaped transfer member is equal to or less than 10.0 mg. An angle of contact of the belt-shaped transfer member with respect to water is at least 60°. A slide resistance of the surface of the belt-shaped transfer member is equal to or less than 1 N.

The image forming apparatus of the present invention forms an image on a transfer material by transferring a toner image formed on an image bearing member onto the transfer material. The apparatus includes a belt-shaped transfer member for transferring a toner image from the image bearing member onto a transfer material, and a cleaning blade for cleaning the belt-shaped transfer member by being brought into contact therewith.

In the present invention, a known electrophotographic photosensitive member can be used as the image bearing member. The image bearing member is not limited to a particular photosensitive member. For example, an OPC (organic photoconductor) photosensitive member having an organic photosensitive layer, or an a(amorphous)-Si-type photosensitive member having an amorphous silicon layer may be used as the image bearing member.

The toner image is transferred from the image bearing member onto a transfer material. At that time, the toner image may be directly transferred onto a transfer material where the final image is to be formed, or may be transferred onto a transfer material (secondary transfer) via transfer onto an intermediate transfer member (primary transfer). That is, the belt-shaped transfer member used in the present invention may be a transfer belt for performing direct image transfer onto a transfer material, or an intermediate transfer belt. The image forming apparatus of the present invention may have both of the above-described belt-shaped transfer members. The transfer material used in, the present invention is not limited to a particular material. A known transfer material, such as ordinary paper, an OHP (overhead projector) sheet or the like, may be used.

The image forming apparatus of the present invention may use various types of known means as means for obtaining an image, depending on the necessity. For example, such means include charging means for charging an image bearing member, exposure means, such as an LED (light-emitting diode) or a laser generation apparatus, for forming an electrostatic latent image on the charged image bearing member, developing means for conveying toner to the image bearing member by carrying the toner on a developing sleeve, transfer means including a transfer member, cleaning means for removing toner particles remaining on the image bearing member after image transfer, pre-exposure means for removing the electrostatic latent image remaining on the image bearing member after image transfer, and fixing means for fixing the transferred toner image borne on the transfer member by heat and/or pressure.

The image forming apparatus of the present invention may be preferably used as a full-color image forming apparatus. A known configuration may be used for the image forming apparatus. For example, as shown in FIG. 1, a configuration in which a plurality of developing means are provided for one image bearing member, and a belt-shaped transfer member is provided as an intermediate transfer member may be adopted. Alternatively, as shown in FIG. 2, a configuration in which a plurality of pairs, each comprising an image bearing member and developing means, are provided, and a belt-shaped transfer member, serving as a transfer-material conveying member for sequentially conveying a transfer material to these pairs and sequentially transferring toner images formed by the respective pairs, is provided may also be adopted.

In the image forming apparatus of the present invention shown in FIG. 1, it is possible to remove toner particles and the like remaining on the belt-shaped transfer member after transfer of a toner image from the belt-shaped transfer member onto a transfer material using the cleaning blade. It is thereby possible to remove stain on the belt-shaped transfer member and suppress changes in the electric property and the like of the belt-shaped transfer member. Hence, it is possible to form high-quality images for a long time.

Figure 2:
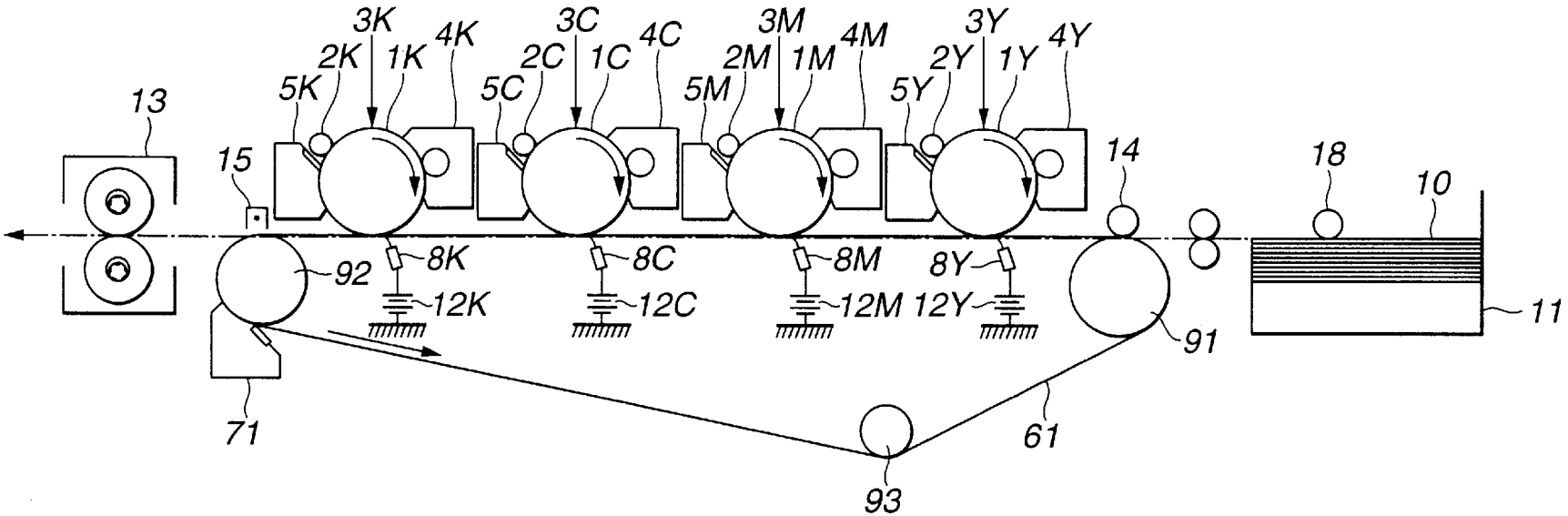
FIG. 2 is a schematic diagram illustrating another example of the configuration of an image forming apparatus utilizing an electrophotographic process applied to the present invention.

In the image forming apparatus of the present invention shown in FIG. 2, it is possible to remove toner particles and particulate substances, such as additives of toner, paper powder and the like, spilt from developer bearing members by the cleaning blade. Toner particles spilt from the developer bearing members include toner particles remaining on the image bearing member after image transfer, toner particles spilt from a developing unit, and the like, i.e., toner particles transferred onto the transfer belt in processes other than development. Thus, it is possible to remove stain on the belt-shaped transfer member and suppress changes in the electric characteristics and the like of the belt-shaped transfer member. As a result, it is possible to form high-quality images for a long time.

In the present invention, shape coefficients SF-1 and SF-2 of toner for forming a toner image have values of $100 \leqq SF\text{-}1 \leqq 125$, and $100 \leqq SF\text{-}2 \leqq 125$, and more preferably, $100 \leqq SF\text{-}1 \leqq 110$, and $100 \leqq SF\text{-}2 \leqq 110$, respectively.

The shape coefficients SF-1 and SF-2 represent the degree of sphericity of toner particles and the degree of projections and recesses of toner particles, respectively. A toner particle is a perfect sphere when the coefficients SF-1 and SF-2 equal 1. These shape coefficients can be measured from a photographed image of toner taken by an image analysis apparatus, an electron microscope or the like, and can be calculated from the absolute maximum length, the circumferential length and the projected area of a toner particle in an image of toner according to the following equations:

$$SF\text{-}1=(MXLNG)^2/AREA\times\pi/4\times100$$

$$SF\text{-}2=(PERIME)^2/AREA\times\tfrac{1}{4}\pi\times100,$$

where MXLNG, PERIME and AREA represent the absolute maximum length, the circumferential length, and the projected area, respectively, of a toner particle.

More specifically, the shape coefficients SF-1 and SF-2 are calculated from the above-described equations using, for example, an electron microscope FE-SEM (S-800) made by Hitachi, Ltd. , randomly sampling 100 toner images magnified by 500 times, and introducing the obtained image information into a image analysis apparatus (Luzex III) made by Nireko Kabushiki Kaisha via an interface.

When the shape coefficients of toner are within the above-described ranges, it can be said that the toner has a shape close to a sphere, has very high flowability and a high transfer property. As each of toner particles approaches a sphere, the adhesive force between toner particles is smaller, and the adhesive force between each toner particle and an image bearing member (for example, an electrophotographic photosensitive member) or a transfer member is smaller, to improve the transfer property. If the shape coefficients of toner exceed the above-described ranges, the adhesive force between toner particles increases. As a result, sufficient transfer efficiency and cleaning property may not be secured.

However, when using toner having very high flowability in the above-described manner in an image forming apparatus including a belt-shaped transfer member, although a high transfer property is obtained, a failure in cleaning sometimes occurs such that when intending to clean toner particles on the belt-shaped transfer member using a cleaning blade, toner particles tend to escape from a small gap between the cleaning blade and the surface of the belt-shaped transfer member.

As a result of investigations with respect to the above-described problem, the inventors of the present invention have found that there is a correlation between the surface characteristics of the belt-shaped transfer member and the cleaning property. That is, by providing arrangement such that the amount of abrasion of the surface of the belt-shaped transfer member has a value equal to or less than 10.0 mg, the angle of contact of the belt-shaped transfer member with respect to water is at least 60°, and the slide resistance of the surface of the belt-shaped transfer member is equal to or less than 1 N, an excellent cleaning property can be obtained even when using toner having the above-described shape coefficients.

If the amount of abrasion of the surface of the belt-shaped transfer member exceeds 10.0 mg, by generating a large amount of abrasion power at a portion near the blade edge due to abrasion between the cleaning blade and the belt-shaped transfer member, the contact state between the cleaning blade and the belt-shaped transfer member becomes unstable to cause escape of toner particles. In the worst case, the surface of the belt-shaped transfer member is roughed to cause a failure in cleaning. The amount of abrasion is preferably equal to or less than 5.0 mg, and more preferably, within a range of 0.1–0.5 mg.

The amount of abrasion is, of course, greatly influenced by the abrasion resistance of a resin used for the belt-shaped transfer member, and can be adjusted to a certain degree by the molecular weight of the resin, the types and the amounts of additives added to the resin, the presence/absence of cross-linking, and the like.

The amount of abrasion in the present invention is the amount of abrasion of the belt-shaped transfer member when appropriate friction is applied during measurement. More specifically, the amount of abrasion is obtained by attaching a #2000 lapping film on an abrasion ring using a pressure sensitive adhesive double coated tape and performing 1,000 abrasive operations by applying a weight of 500 g at a rotational speed of 60 rpm using an abrasion tester No. 101 (made by Yasuda Seiki Kabushiki Kaisha).

If the angle of contact of the belt-shaped transfer member with respect to water is less than 60° and the slide resistance of the surface of the belt-shaped transfer member is more than 1 N, since the transfer efficiency is low and stable contact of the blade cannot be obtained, the cleaning property tends to decrease.

The angle of contact of the surface of the belt-shaped transfer member with respect to water in the present invention is measured using a goniometer-type contact-angle measuring apparatus (made by Kyowa Kaimen Kagaku Kabushiki Kaisha).

The slide resistance in the present invention is represented by the slide resistance of a sample sheet made by composite materials for the belt-shaped transfer member with respect to a polyethylene terephthalate (PET) sheet. More specifically, the slide resistance is measured using a surface-property measuring apparatus HEIDON-14DR (made by Shinsoku Kagaku Kabushiki Kaisha). In more detail, a polyethylene terephthalate (PET) sheet is wound around a plane indenter specified by ASTM (American Society for Testing Materials) D-1894 of the HEIDON-14DR to provide a substance to be measured. The slide resistance between the PET sheet and the sample sheet is measured by moving the sample sheet at a speed of 100 mm/min while applying a vertical weight of 2 N between the sample sheet and the plane indenter.

The belt-shaped transfer member of the present invention must have a seamless shape in which a seam is absent. If the belt-shaped transfer member has a seam, the cleaning property of the blade is inferior due to a step at the seam, and chipping or abnormal abrasion occurs at the edge portion of the cleaning blade while being used, thereby causing problems during the use for a long time.

A seamless belt-shaped transfer member may be produced, for example, according to a centrifugal forming method, a dipping method, a spray coating method, an extrusion method using an annular die, or an inflation forming method. Any production method may be adopted, provided that a seamless shape can be obtained. Each known production method, such as method of providing a resin layer whose characteristics are different from the characteristics of the formed belt on the belt, may be utilized.

The present invention has the feature of having a cleaning blade for cleaning a belt-shaped transfer member by being brought into contact therewith. A known elastic blade or the like may be used as the cleaning blade. As shown in FIGS. 1 and 2, the cleaning blade for cleaning the belt-shaped transfer member contacts. the belt-shaped transfer member preferably from a direction opposite to the moving direction of the belt-shaped transfer member at a contact portion, in order to obtain a stable cleaning property for the belt-shaped transfer member.

The contact pressure of the cleaning blade against the belt-shaped transfer member is preferably within a range of linear pressure of 2–50 N/m. The linear pressure is a value obtained by dividing the force applied to the overall width of the blade by the length of the contact portion of the blade. If the linear pressure is less than 2 N/m, a failure in cleaning tends to occur. If the linear pressure exceeds 50 N/m, the torque when driving the belt-shaped transfer member is sometimes too large, resulting in an increase in the size of a driving motor.

A resin used for the belt-shaped transfer member of the present invention may be an ethylene-vinyl alcohol copolymer (EVOH); polyethylene; polypropylene; polystyrene; ABS (acrylonitrile butadiene styrene) resin; polyacetal; polycarbonate; a polyester such as polyethylene terephthalate or polybutylene terephthalate; methacrylic resin; polyamide; polyurethane; denaturated polyphenylene ether; polyphenylene sulfide; polyarylate; polysulfone; polyethersulfone; polyamideimide; thermoplastic polyimide; thermosetting polyimide; polyether; etherketone; aliphatic polyketnone; polymethylpentene; a fluororesin, such as polyvinylidene fluoride, an ethylene-tetrafluoroethylene copolymer, a tetrafluroethylene-perfluoroalkylvinylether copolymer, a fluorinated ethylene propylene copolymer, or tetrafluoroethylene; or a liquid-crystal polymer. At least two of the above-described materials may, of course, be mixed. Alternatively, a known thermoplastic resin, such as a polymer alloy or the like, may also be used. The main component of the belt-shaped transfer member is preferably a thermoplastic pblyimide resin because the amount of abrasion is very small and the mechanical strength is excellent. In the present invention, the main component indicates a component which is included in an amount of at least 50 mass % of the belt-shaped transfer member.

In the present invention, various additives may be added in order to adjust the electric resistance of the belt-shaped transfer member. Such additives include conductive materials, such as carbon black, tin oxide, perchlorates, and surface active agents; fillers, such as talc, mica, and calcium carbonate; fire retarding materials, such as magnesium hydroxide, and antimony trioxide; and antioxidants, such as t-butylhydroxytoluene. However, the additives are not limited to the above-described materials. Any arbitrary additives may also be used.

In order to faithfully reproduce fine dots of a latent image, toner preferably has a weight-average particle diameter equal to or less than 10 $\mu$m (more preferably, 4 $\mu$m–8 $\mu$m), and a coefficient of variation (A) in the number distribution equal to or less than 35% (more preferably, equal to or less than 30%). In toner having a weight-average particle diameter less than 4 μm, a large amount of toner particles tend to remain on the photosensitive member or the intermediate transfer member after image transfer due to a decrease in the transfer efficiency, and unevenness in the image due to fog or a failure in image transfer also tends to occur. If the weight-average particle diameter of toner exceeds 10 μm, fusion of toner particles on the surface of the photosensitive member, the transfer, member and the like tends to occur. Such tendency is further enhanced if the coefficient of variation in the number distribution of toner exceeds 35%.

The weight-average particle diameter and the coefficient of variation of toner can be measured according to various methods. A measuring method using a Coulter counter will now be described as a specific example.

For example, a Coulter counter type TA-II (made by Coulter Corporation) is used, and an interface (made by Nikkaki Kabushiki Kaisha) for outputting the number distribution and the volume distribution, and a personal computer are connected. Using first-grade sodium chloride, an aqueous solution containing about 1% NaCl is prepared as an electrolytic solution. For example, ISOTON II (made by Coulter Scientific Japan Kabushiki Kaisha) can be used as the electrolytic solution.

In the measuring method, 0.1–5 ml of a surface-active agent (preferably an alkyl benzene sodium sulfonate salt) is added in 100–150 ml of the above-described electrolytic solution as a dispersing agent, and 2–20 mg of a sample to be measured is also added. The electrolytic solution suspending the sample is subjected to dispersion processing for 1–3 minutes using an ultrasonic disperser. The particle-size distribution of toner particles having diameters of 2–40 μm is measured based on the volume and the number of toner particles, using an aperture of 100 μm by the Coulter counter type TA-II, in order to obtain the weight-average particle diameter.

The weight-average particle diameter is obtained from the measured volume distribution using a median of each channel as a representative value for the channel. The coefficient of variation (A) in the number distribution of toner is calculated according to the following equation. In the present invention, 13 channels having particle diameters of 2.00—less than 2.52 μm, 2.52—less than 3.17 μm, 3.17—less than 4.00 μm, 4.00—less than 5.04 μm, 5.04—less than 6.35 μm, 6.35—less than 8.00 μm, 8.00—less than 10.08 μm, 10.08—less than 12.70μm, 12.70—less than 16.00 μm, 16.00—less than 20.20 μm, 20.20—less than 25.40 μm, 25.40—less than 32.00 μm, 32.00—less than 40.30 μm, are used.

$$\text{Coefficient of variation } (A)=(S/D_1)\times 100,$$

where S represents the value of standard deviation in the number distribution, and $D_1$ represents the number mean particle diameter (μm) of toner.

The toner used in the presents invention may be manufactured by using various known materials, for example, a binding resin, such as polystyrene, styrene-acrylic resin or polyester resin, a coloring agent, such as a dye or a pigment, a releasing agent such as wax, a charge control agent, such as an organometallic compound, a magnetic material, such as ferrite, inorganic fine power, such as silica, and the like, depending on the necessity. Each known method may be used for manufacturing toner. An organic compound having at least two double bonds, serving as a cross-linking agent, and an organic peroxide, serving as a polymerization accelerator may also be used depending on the manufacturing method. When directly manufacturing toner particles according to polymerization, such as suspension polymerization, emulsification polymerization, or dispersion polymerization, various known auxiliary materials, for example, an emulsifier such as an anionic surface-active agent, a dispersion stabilizer such as a slightly soluble inorganic metallic salt, hydrochloric acid, serving as a pH adjusting agent, and the like may be used depending on the necessity.

In addition to a toner manufacturing method according to pulverization in which after uniformly dispersing a releasing agent, a coloring agent, a charge control agent and the like comprising resins, or low-softening-point substances using a pressure kneader, an extruder or a media disperser, the obtained mixture is caused to impinge upon a target mechanically or in a jet stream, and after pulverizing the mixture into toner particles having a desired particle diameter (adding a process of smoothing the toner particles and causing the toner particles to have a spherical shape if necessary), the particle-size distribution is sharpened by passing through a classification process to obtain toner, toner may also be manufactured according to a method described, for example, in Japanese Patent Publication No. 56-13945 (1981) in which spherical toner is obtained by atomizing a fused mixture in air using a disc or multi-fluid nozzles, a method described in Japanese Patent Publication No. 36-10231 (1961), and Japanese Patent Application Laid-Open (Kokai) Nos. 59-53856 (1984) and 59-61842 (1984) in which toner is directly obtained using a suspension polymerization method, a dispersion polymerization method in which toner is directly generated using an aqueous organic solvent where a monomer is soluble but an obtained polymer is insoluble, an emulsification polymerization method represented by a soap-free polymerization method in which toner is directly generated by directly performing polymerization in the presence of a water-soluble polar polymerization accelerator, or the like.

In the method for manufacturing toner using pulverization, it is difficult to make the shape coefficient SF-1 of toner within a range of 100–150, and the particle size distribution of the obtained toner tends to widen even if the value of SF-1 can be within a predetermined range by performing processing for causing the toner to have a spherical shape, such as a fusion spray method. On the other hand, in the dispersion polymerization method, although the obtained toner has a very sharp particle-size distribution, the range of selection of materials to be used is narrow, and a manufacturing apparatus tends to have a complicated structure due. to the necessity of processing a waste solvent as a result of use of an organic solvent, and inflammability of the solvent. Although the emulsification polymerization method represented by the soap-free polymerization method is effective because the particle-size distribution of toner is relatively sharp, presence of end groups of the used emulsifier and polymerization accelerator on the surfaces of toner particles sometimes degrades the environment characteristics.

As the toner manufacturing method of the present invention, the suspension polymerization method in the atmospheric pressure or under pressure in which the shape coefficient of toner can be controlled and toner fine particles having particle diameters of 4–8 μm and a sharp particle-size distribution are easily obtained is particularly preferable. A seed polymerization method in which after causing monomers to be adsorbed on obtained polymer particles, polymerization is performed using a polymerization accelerator may also be preferably used in the present invention.

The present invention will now be more specifically described illustrating examples.

EXAMPLE 1

A seamless belt made of a thermosetting polyimide resin whose resistance was adjusted using conductive carbon black was manufactured according to centrifugal forming. The amount of abrasion of the obtained seamless belt was 0.3 mg, and the contact angle and the slide resistance of the surface of the belt with respect to water was 68° and 0.4 N, respectively. Magenta toner, cyan toner, yellow toner and black toner were manufactured according to suspension polymerization. The weight average particle diameter of the obtained toner was 6.2 $\mu$m, the coefficient of variation in the number distribution was 28%, and the values of SF-1 and SF-2 were 107 and 111, respectively.

The seamless belt obtained in the above-described manner was incorporated as the intermediate transfer belt of the image forming apparatus shown in FIG. 1, the obtained toners were accommodated in respective developing units, and an output test of a full-color image was performed on paper of 80 g/m$^2$. An elastic blade was used as an intermediate-transfer-belt cleaner, and the linear pressure during contact was set to 30 N/m.

Excellent results were obtained such that the efficiency of primary transfer from the photosensitive drum, serving as the image bearing member, onto the intermediate transfer belt was 97%, and the efficiency of secondary transfer from the intermediate transfer belt onto paper of 80 g/m$^2$, serving as a transfer material, was 94%. The efficiencies of transfer in Example 1 are defined as follows:

Efficiency of primary transfer (%)=the image density on the intermediate transfer belt×100/(the image density on the photosensitive drum after image transfer+the image density on the intermediate transfer belt)

Efficiency of secondary transfer (%)=the image density on the paper×100/(the image density on the paper+the image density on the intermediate transfer belt)

The result of a durability test for 10,000 sheets indicates that a failure in cleaning of the intermediate transfer belt did not occur from the start of the test, and an excellent cleaning property as in the initial state was maintained even after the test for the 10,000-th sheet.

EXAMPLE 2

A seamless belt made of a polycarbonate resin whose resistance was adjusted using conductive carbon black was manufactured according to extrusion forming. The amount of abrasion of the obtained seamless belt was 3.8 mg, and the contact angle and the slide resistance of the surface of the belt with respect to water was 84° and 0.5 N, respectively.

The seamless belt obtained in the above-described manner was incorporated as the transfer-material conveying belt of the image forming apparatus shown in FIG. 2, the same toners as in Example 1 were accommodated in respective developing units, and an output test of a full-color image was performed on paper of 80 g/m$^2$ in the same manner as in Example 1. An elastic blade was used as a transfer-material-conveying-belt cleaner, and the linear pressure during contact was set to 30 N/m.

Excellent results were obtained such that the transfer efficiency from the photosensitive drum, serving as the image bearing member, onto paper of 80 g/m$^2$ was 97%. The result of a durability test for 10,000 sheets indicated that a failure in cleaning of the transfer-material conveying belt did not occur from the start of the test, and an excellent cleaning property as in the initial state was maintained even after the test for the 10,000-th sheet.

EXAMPLE 3

A seamless belt made of a polysulfone resin whose resistance was adjusted using conductive carbon black and whose slidability was improved by adding tetrafluoroethylene resin-particles (having a particle diameter of 0.2 $\mu$m) was manufactured according to extrusion forming. The amount of abrasion of the obtained seamless belt was 9.3 mg, and the contact angle and the slide resistance of the surface of the belt with respect to water was 90° and 0.4 N, respectively.

The seamless belt obtained in the above-described manner was incorporated as the intermediate transfer belt of the image forming apparatus shown in FIG. 1, the same toners as in Example 1 were accommodated in respective developing units, and an output test of a full-color image was performed on paper of 80 g/m$^2$. An elastic blade was used as an intermediate-transfer-belt cleaner, and the linear pressure during contact was set to 30 N/m.

Excellent results were obtained such that the efficiency of primary transfer from the photosensitive drum, serving as the image bearing member, onto the intermediate transfer belt was 95%, and the efficiency of secondary transfer from the intermediate transfer belt onto paper of 80 g/m$^2$ was 95%. The result of a durability test for 10,000 sheets indicated that a failure in cleaning of the intermediate transfer belt did not occur at initial stages of the test. Although a very slight failure in cleaning was observed starting from the test for about 8,000 sheets, the level of the failure was such that no practical problem arose.

EXAMPLE 4

Magenta toner, cyan toner, yellow toner and black toner were manufactured according to emulsification polymerization. The weight average particle diameter of the obtained toner was 8.5 $\mu$m, the coefficient of variation in the number distribution was 30%, and the values of SF-1 and SF-2 were 113 and 116, respectively. The seamless belt obtained in the above-described manner was incorporated as the intermediate transfer belt of the image forming apparatus shown in FIG. 1, the obtained toners were accommodated in respective developing units, and an output test of a full-color image was performed on paper of 80 g/m$^2$ as in Example 1. An elastic blade was used as an intermediate-belt cleaner, and the linear pressure during contact was set to 30 N/m.

Excellent results were obtained such that the efficiency of primary transfer from the photosensitive drum, serving as the image bearing member, onto the intermediate transfer belt was 94%, and the efficiency of secondary transfer from the intermediate transfer belt onto paper of 80 g/m$^2$, serving as a transfer material, was 92%. The result of a durability test for 10,000 sheets indicates that a failure in cleaning of the intermediate transfer belt did not occur from the start of the test, and an excellent cleaning property as in the initial state was maintained even after the test for the 10,000-th sheet.

COMPARATIVE EXAMPLE 1

Magenta toner, cyan toner, yellow toner and black toner were obtained by manufacturing fine particles according to pulverization and processing the fine particles to have a spherical shape. The weight average particle diameter of the obtained toner was 7.3 $\mu$m, the coefficient of variation in the number distribution was 33%, and the values of SF-1 and SF-2 were 140 and 132, respectively.

The same seamless belt as in Example 1 was incorporated as the intermediate transfer belt of the image forming apparatus shown in FIG. 1, the obtained toners were accommodated in respective developing units, and an output test of a full-color image was performed on paper of 80 g/m$^2$ as in Example 1. An elastic blade was used as an intermediate-transfer-belt cleaner, and the linear pressure during contact was set to 30 N/m.

The efficiencies of image transfer were low such that the efficiency of primary transfer from the photosensitive drum, serving as the image bearing member, onto the intermediate transfer belt was 90%, and the efficiency of secondary transfer from the intermediate transfer belt onto paper of 80 g/m$^2$, serving as a transfer material, was 87%. As a result, the image density was low. The result of a durability test for 10,000 sheets indicated that a failure in cleaning of the intermediate transfer belt did not occur from the start of the test, and an excellent cleaning property as in the initial state was maintained even after the test for the 10,000-th sheet.

EXAMPLE 5

A seamless belt made of a thermosetting polyimide resin whose resistance was adjusted in the same manner as in Example 1 was manufactured according to centrifugal forming. A coated layer about 20 $\mu$m thick was formed on the obtained belt by performing spray coating of a polyurethane paint whose resistance was adjusted using conductive tin oxide and whose slidability was improved by adding tetrafluroethylene-resin particles (having a particle diameter of 0.2 $\mu$m) and drying the coated layer by heating. The amount of abrasion of the belt having the coated layer obtained in the above-described manner was 2.5 mg, and the contact angle and the slide resistance of the surface of the belt with respect to water was 90° and 0.9 N, respectively.

The seamless belt obtained in the above-described manner was incorporated as the intermediate transfer belt of the image forming apparatus shown in FIG. 1, the same toners as in Example 1 were accommodated in respective developing units, and an output test of a full-color image was performed on paper of 80 g/m$^2$. An elastic blade was used as an intermediate-transfer-belt cleaner, and the linear pressure during contact was set to 30 N/m.

The efficiencies of image transfer were more or less low such that the efficiency of primary transfer from the photosensitive drum, serving as the image bearing member, onto the intermediate transfer belt was 92%, and the efficiency of secondary transfer from the intermediate transfer belt onto paper of 80 g/m$^2$ was 91%. As a result, the image density was more or less low, but the level of the image density was such that no practical problem arose. The result of a durability test for 10,000 sheets indicated that although a very slight failure in cleaning occurred on the intermediate transfer belt from the start of the test, the level of the failure was such that no practical problem arose. The cleaning property did not change even after a durability test for 10,000 sheets, so that a substantially excellent image was obtained.

COMPARATIVE EXAMPLE 2

A seamless belt made of a polysulfone resin whose resistance was adjusted using conductive carbon black was manufactured according to extrusion forming. The amount of abrasion of the obtained seamless belt was 11.0 mg, and the contact angle and the slide resistance of the surface of the belt with respect to water was 76° and 0.5 N, respectively.

The seamless belt obtained in the above-described manner was incorporated as the intermediate transfer belt of the image forming apparatus shown in FIG. 1, the same toners as in Example 1 were accommodated in respective developing units, and an output test of a full-color image was performed on paper of 80 g/m$^2$ in the same manner as in Example 1. An elastic blade was used as an intermediate-transfer-belt cleaner, and the linear pressure during contact was set to 30 N/m.

Excellent results were obtained such that the efficiency of primary transfer from the photosensitive drum, serving as the image bearing member, onto the intermediate transfer belt was 95%, and the efficiency of secondary transfer from the intermediate transfer belt onto paper of 80 g/m$^2$ was 95%. The result of a durability test for 10,000 sheets indicated that a slight failure in cleaning occurred on the intermediate transfer belt from the start of the test, and a failure in cleaning became pronounced as the test proceeded. Since a failure in cleaning of an impermissible level occurred starting from about the 3,000-th sheet, the durability test was interrupted.

COMPARATIVE EXAMPLE 3

Magenta toner, cyan toner, yellow toner and black toner were manufactured according to pulverization. The weight average particle diameter of the obtained toner was 7.8 $\mu$m, the coefficient of variation in the number distribution was 38%, and the values of SF-1 and SF-2 were 163 and 150, respectively.

The same seamless belt as in Example 1 was incorporated as the intermediate transfer belt of the image forming apparatus shown in FIG. 1, the obtained toners were accommodated in respective developing units, and an output test of a full-color image was performed on paper of 80 g/m$^2$ as in Example 1. An elastic blade was used as an intermediate-transfer-belt cleaner, and the linear pressure during contact was set to 30 N/m.

The efficiencies of image transfer were very low such that the efficiency of primary transfer from the photosensitive drum, serving as the image bearing member, onto the intermediate transfer belt was 83%, and the efficiency of secondary transfer from the intermediate transfer belt onto paper of 80 g/m$^2$, serving as a transfer material, was 80%. As a result, the image density was very low. Hence, a durability test was not performed.

COMPARATIVE EXAMPLE 4

A seamless belt made of a thermosetting polyimide resin whose resistance was adjusted in the same manner as in Example 1 was manufactured according to centrifugal forming. A coated layer about 20 $\mu$m thick was formed on the obtained belt by performing spray coating of a polyurethane paint whose resistance was adjusted using conductive tin oxide and drying the coated layer by heating. The amount of abrasion of the belt having the coated layer obtained in the above-described manner was 1.8 mg, and the contact angle and the slide resistance of the surface of the belt with respect to water was 81 and 1.2 N, respectively.

The seamless belt obtained in the above-described manner was incorporated as the intermediate transfer belt of the image forming apparatus shown in FIG. 1, the same toners as in Example 1 were accommodated in respective developing units, and an output test of a full-color image was performed on paper of 80 g/m$^2$. An elastic blade was used as an intermediate-transfer-belt cleaner, and the linear pressure during contact was set to 30 N/m.

The efficiencies of image transfer were low such that the efficiency of primary transfer from the photosensitive drum, serving as the image bearing member, onto the intermediate transfer belt was 88%, and the efficiency of secondary transfer from the intermediate transfer belt onto paper of 80 g/m$^2$ was 81%. As a result, the image density was very low, and a failure in cleaning occurred. Hence, a durability test was not performed.

COMPARATIVE EXAMPLE 5

A belt having a seam was manufactured by ultrasonically fusing both ends of a sheet made of polyethylene terephthalate (PET) resin on the back of which aluminum was deposited in vacuum. A coated layer about 20 $\mu$m thick was formed on the obtained belt by performing spray coating of a polyurethane paint whose resistance was adjusted using conductive tin oxide and whose slidability was improved by adding tetrafluroethylene-resin particles (having a particle diameter of 0.2 $\mu$m) as in Example 5 and drying the coated layer by heating. The amount of abrasion of the belt having the coated layer obtained in the above-described manner was 2.5 mg, and the contact angle and the slide resistance of the surface of the belt with respect to water was 90° and 0.9 N, respectively.

The belt having the seam obtained in the above-described manner was incorporated as the transfer-material conveying belt of the image forming apparatus shown in FIG. 2, the same toners as in Example 1 were accommodated in respective developing units, and an output test of a full-color image was performed on paper of 80 g/m$^2$ in the same manner as in Example 1. An elastic blade was used as a transfer-material-conveying-belt cleaner, and the linear pressure during contact was set to 30 N/m.

An excellent result was obtained such that the efficiency of image transfer from the photosensitive drum, serving as the image bearing member, onto paper of 80 g/m$^2$ was 96%. However, image transfer absent at a seam portion of the transfer-material conveying belt, and a failure in cleaning of the transfer-material conveying belt occurred. Hence, a durability test was not performed.

The individual components shown in outline in the drawings are all well known in the full-color image forming apparatus arts and their specific construction and operation are not critical to the operation or the best mode for carrying out the invention. While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A full-color image forming apparatus for forming an image on a transfer material by transferring a toner image formed on an image bearing member onto the transfer material, said apparatus comprising:

a belt-shaped transfer member for transferring a toner image from the image bearing member onto a transfer material; and a cleaning blade for cleaning said belt-shaped transfer member by being brought into contact therewith, wherein shape coefficients SF-1 and SF-2 of a toner for forming the toner image have values of $100 \leqq SF\text{-}1 \leqq 125$, and $100 \leqq SF\text{-}2 \leqq 125$, respectively, wherein said belt-shaped transfer member has a seamless shape in which a seam is absent, wherein an amount of abrasion of a surface of said belt-shaped transfer member is equal to or less than 10.0 mg, and wherein an angle of contact of a surface of said belt-shaped transfer member with respect to water is at least 60°, and wherein a slide resistance of a surface of said belt-shaped transfer member is equal to or less than 1 N.

2. The full-color image forming apparatus according to claim 1, wherein the values of the shape coefficients SF-1 and SF-2 of a color toner are $100 \leqq SF\text{-}1 \leqq 110$, and $100 \leqq SF\text{-}2 \leqq 110$, respectively.

3. The full-color image forming apparatus according to claim 1, wherein said cleaning blade for cleaning said belt-shaped transfer member is brought into contact with said belt-shaped transfer member from a direction opposite to a moving direction of said belt-shaped transfer member.

4. The full-color image forming apparatus according to claim 1, wherein said cleaning blade for cleaning said belt-shaped transfer member is brought into contact with said belt-shaped transfer member by applying a linear pressure of 2–50 N/m.

5. The full-color image forming apparatus according to claim 1, wherein the amount of abrasion of the surface of said belt-shaped transfer member is equal to or less than 5.0 mg.

6. The full-color image forming. apparatus according to claim 1, wherein said belt-shaped transfer member includes a thermosetting polyimide resin as a main component.

7. The full-color image forming apparatus according to claim 1, wherein said belt-shape transfer member is a transfer belt for directly transferring the toner image from the image bearing member onto the transfer material.

8. The full-color image forming apparatus according to claim 1, wherein said belt-shaped image transfer member is an intermediate transfer belt for transferring the toner image from the image bearing member onto the transfer material via said belt-shaped transfer member.

9. The full-color image forming apparatus according to claim 1, wherein the toner has an weight average particle diameter equal to or less than 10 $\mu$m, and a coefficient of number variation equal to or less than 35%.

10. The full-color image forming apparatus according to claim 9, wherein the toner has a weight average particle diameter of 4–8 $\mu$m.

11. The full-color image forming apparatus according to claim 10, wherein the toner has a coefficient of number variation equal to or less than 30%.

12. The full-color image forming apparatus according to claim 1, wherein the toner is a polymerized toner produced by suspension polymerization.

13. The full-color image forming apparatus according to claim 1, wherein the toner is a polymerized toner produced by emulsification polymerization.

* * * * *

UNITED STATES PATENT AND TRADEMARK OFFICE

CERTIFICATE OF CORRECTION

PATENT NO. : 6,487,387 B2 
DATED : November 26, 2002
INVENTOR(S) : Takashi Kusaba et al.

It is certified that error appears in the above-identified patent and that said Letters Patent is hereby corrected as shown below:

Title page,
Item [56], FOREIGN PATENT DOCUMENTS, "JP 36-10231 3/1934" should read -- JP 36-10231 7/1961 --.

Column 1,
Line 45, "by," should read -- by --.

Column 2,
Line 3, "12" should read -- 17 --;
Line 26, "to" should read -- with --; and
Line 30, "from" should read -- by --.

Column 3,
Line 3, "belt," should read -- belt, and --.

Column 5,
Line 20, "in," should read -- in --; and
Line 55, "provided" should read -- provided and --.

Column 6,
Line 39, "into a" should read -- into an --; and
Line 66, "providing" should read -- providing an --.

Column 8,
Line 13, "contacts." should read -- contacts --; and
Line 37, "polyether; etherketone;" should read -- polyether · etherketone; --.

Column 9,
Line 8, "transfer," should read -- transfer --; and
Line 54, "presents" should read -- present --.

Column 10,
Line 47, "due." should read -- due --; and
Line 67, "illustrating" should read -- in the illustrating --.

Column 14,
Line 55, "81" should read -- 81° --.

UNITED STATES PATENT AND TRADEMARK OFFICE

CERTIFICATE OF CORRECTION

PATENT NO. : 6,487,387 B2 
DATED : November 26, 2002
INVENTOR(S) : Takashi Kusaba et al.

It is certified that error appears in the above-identified patent and that said Letters Patent is hereby corrected as shown below:

Column 15,
Line 43, "While the present invention has been" should read -- ¶While the present invention has been --.

Signed and Sealed this

Twelfth Day of August, 2003

JAMES E. ROGAN
*Director of the United States Patent and Trademark Office*